US012747935B2

(12) United States Patent
Martin

(10) Patent No.: US 12,747,935 B2
(45) Date of Patent: Sep. 29, 2026

(54) FIREARM PROJECTILE DEVICE

(71) Applicant: Thomas Martin, Emmett, ID (US)

(72) Inventor: Thomas Martin, Emmett, ID (US)

( * ) Notice: Subject to any disclaimer, the term of this patent is extended or adjusted under 35 U.S.C. 154(b) by 0 days.

(21) Appl. No.: 19/285,357

(22) Filed: Jul. 30, 2025

(65) Prior Publication Data

US 2025/0354786 A1 Nov. 20, 2025

Related U.S. Application Data

(63) Continuation of application No. 18/600,856, filed on Mar. 11, 2024, now Pat. No. 12,398,986.

(60) Provisional application No. 63/584,942, filed on Sep. 25, 2023.

(51) Int. Cl.

| | |
|---|---|
| ***F42B 10/42*** | (2006.01) |
| ***F42B 12/76*** | (2006.01) |
| ***F42B 30/02*** | (2006.01) |

(52) U.S. Cl.

CPC ..... *F42B 10/42* (2013.01); *F42B 12/76* (2013.01); *F42B 30/02* (2013.01)

(58) Field of Classification Search

CPC ..... F42B 10/42; F42B 12/76; F42B 30/02
USPC ..... 102/501
See application file for complete search history.

(56) References Cited

U.S. PATENT DOCUMENTS

| | | | | | |
|---|---|---|---|---|---|
| 1,043,547 | A * | 11/1912 | Stanbridge | F42B 12/74 | 102/501 |
| 2,377,839 | A * | 6/1945 | Dake | F42B 10/44 | 102/514 |
| 2,493,938 | A * | 1/1950 | Albree | F42B 30/00 | 102/439 |
| 4,945,836 | A * | 8/1990 | Michaels | F42B 10/34 | 102/517 |
| 5,058,503 | A * | 10/1991 | Adams, III | F42B 30/08 | 102/501 |
| 5,798,478 | A * | 8/1998 | Beal | F42B 10/44 | 102/490 |
| 8,893,621 | B1 * | 11/2014 | Escobar | F42B 10/44 | 102/524 |
| 11,378,368 | B2 * | 7/2022 | Peterson | F42B 14/02 | |
| 12,398,986 | B2 * | 8/2025 | Martin | F42B 12/76 | |
| 2016/0153757 | A1 * | 6/2016 | Mahnke | F42B 12/34 | 102/501 |
| 2016/0169644 | A1 * | 6/2016 | Ziegler | F42B 10/38 | 244/3.23 |
| 2017/0089677 | A1 * | 3/2017 | Boatright | F42B 30/02 | |
| 2020/0256656 | A1 * | 8/2020 | Thielen | F42B 10/46 | |
| 2021/0364260 | A1 * | 11/2021 | Blank | F42B 10/44 | |

* cited by examiner

*Primary Examiner* — Samir Abdosh
(74) *Attorney, Agent, or Firm* — Brennan, Manna & Diamond, LLC

(57) ABSTRACT

A firearm projectile device is provided. The device is comprised of a projectile body with a partially hollow area that allows air to travel through the projectile and reduces the projectile's coefficient of drag. Both ends of the device are preferably pointed to further reduce the coefficient of drag of the device. In addition, the second end attaches to a fitted gas block that seals the projectile from a propellant within the casing of the device.

9 Claims, 2 Drawing Sheets

FIREARM PROJECTILE DEVICE

CROSS-REFERENCE TO RELATED APPLICATION

The present application is a continuation of, and claims priority to and the benefit of, U.S. patent application Ser. No. 18/600,856, which was filed on Mar. 11, 2024, which claims priority to and the benefit of U.S. Provisional Application No. 63/584,942, which was filed on Sep. 25, 2023, both of which are incorporated herein by reference in their entirety.

FIELD OF THE INVENTION

The present invention relates generally to the field of firearm projectiles. More specifically, the present invention relates to a firearm projectile device that in one embodiment is partially hollow such that the projectile has a reduced coefficient of drag. Accordingly, the present disclosure makes specific reference thereto. Nonetheless, it is to be appreciated that aspects of the present invention are also equally applicable to other like applications, devices, and methods of manufacture.

BACKGROUND

Enhancing the aerodynamic properties of a projectile by decreasing its coefficient of drag (CdA) significantly improves its performance in flight. When the drag is minimized, the projectile can travel greater distances with reduced energy loss, thereby ensuring a more efficient trajectory. Conversely, when a projectile is slowed down due to higher drag or other factors, its range diminishes. This reduction in speed compromises the effective distance the user can achieve, making it crucial to optimize the aerodynamic properties for maximum range and efficiency.

Traditional bullets and many other types of projectiles have designs that have been refined over the centuries. Their shapes, while efficient for their intended purposes such as stability in flight or terminal performance, may not be perfectly optimized for aerodynamics. Traditional bullet designs prioritize stability and rotational balance. Spitzer or round-nose designs, while stable, may not be the most aerodynamic shapes. The boundary layer of air around the bullet can become turbulent, increasing drag and thus reducing the distance the projectile can travel.

Therefore, there exists a long-felt need in the art for a projectile that increases the range and effectiveness of a firearm and/or artillery. There also exists a long-felt need in the art for a firearm projectile device. More specifically, there exists a long-felt need in the art for a firearm projectile device that increases the range and effectiveness of a firearm and/or artillery by decreasing the coefficient of drag on the projectile when fired.

The subject matter disclosed and claimed herein, in one embodiment thereof, comprises a firearm projectile device. The device is comprised of a projectile body with a partially hollow area that allows air to travel through the projectile and reduces the projectile's coefficient of drag. Both ends of the device are preferably pointed to further reduce the coefficient of drag of the device. In addition, the second end attaches to a fitted gas block that seals the projectile from a propellant within the casing of the device.

In this manner, the firearm projectile device of the present invention accomplishes all the foregoing objectives and provides an improved projectile that increases the range and effectiveness of a firearm and/or artillery. More specifically, the device increases the range and effectiveness of a firearm and/or artillery. To do so, the hollow configuration of the device decreases the coefficient of drag on the projectile when fired.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a firearm projectile device. The device is comprised of a projectile body with a first pointed end and a second pointed end, wherein at least one gas block is fixedly attached to the second end. The device provides a projectile with a lower drag coefficient than existing projectiles/bullets to improve projectile performance.

The body of the device may be made from any projectile material known in the art. The body may also be sized and dimensions for use with any caliber or type of firearm/artillery. In one embodiment, the body is a solid body of continuous construction. In another embodiment, the body is comprised of at least one hollow area that preferably runs the length of the body but terminates at the second end. This embodiment allows more air to pass through the body thus reducing drag and resistance when the device is traveling through the air.

The first end and second end of the body are each comprised of a pointed angle. Said angle is preferably, but is not limited to, 1.74 degrees. The second is also fixedly attached to at least one gas block which seals exploding gases from the propellant such that the body is propelled out of the casing and barrel of the firearm. The device may also be comprised of a propellant and a primer.

The present invention is also comprised of a method of using the device. First, a device is provided comprised of a body comprised of a hollow area, at least one gas block attached to a second end of the body, at least one primer, at least one propellant, and at least one casing. Then, the second end of the body is attached to the gas block. Next, the second end, gas block, propellant, and primer are placed into the casing. Then, the device 100 can be fired from a firearm and/or artillery.

Accordingly, the firearm projectile device of the present invention is particularly advantageous as it provides an improved projectile that increases the range and effectiveness of a firearm and/or artillery. More specifically, the device increases the range and effectiveness of a firearm and/or artillery. To do so, the hollow configuration of the device decreases the coefficient of drag on the projectile when fired. In this manner, the firearm projectile device overcomes the limitations of existing projectiles known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
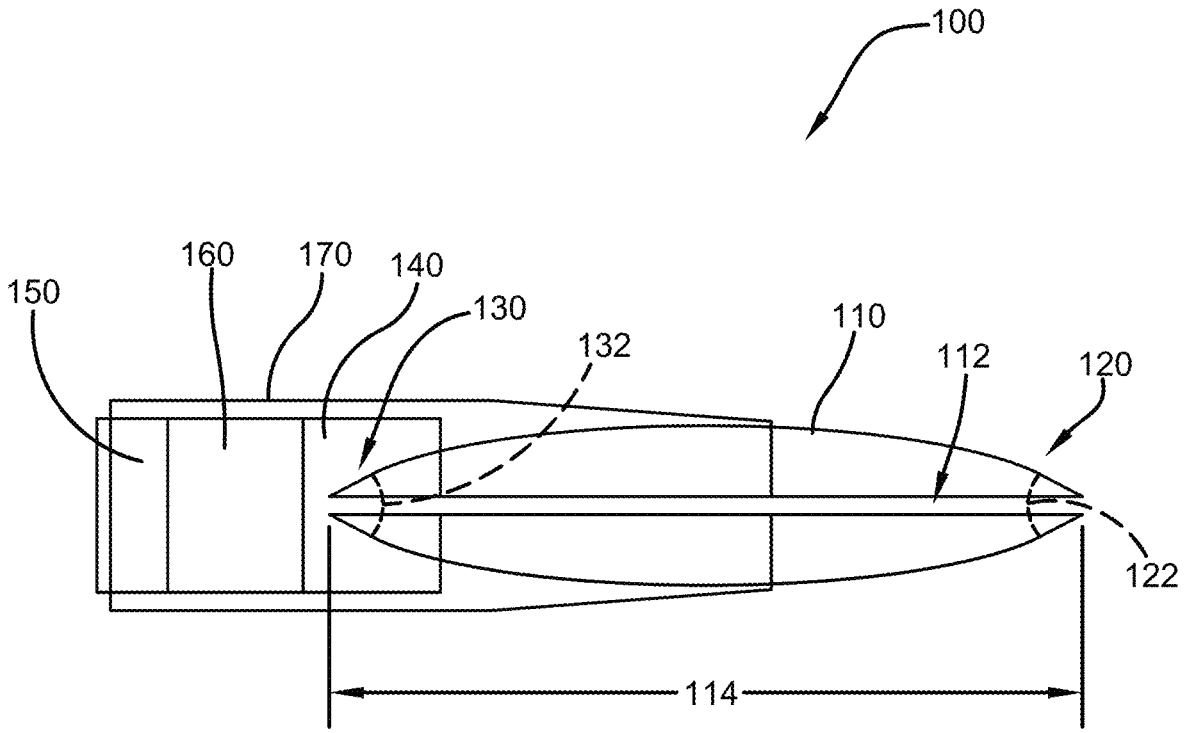
FIG. 1 illustrates a side cross-sectional view of one potential embodiment of a firearm projectile device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a projectile that increases the range and effectiveness of a firearm and/or artillery. There also exists a long-felt need in the art for a firearm projectile device. More specifically, there exists a long-felt need in the art for a firearm projectile device that increases the range and effectiveness of a firearm and/or artillery by decreasing the coefficient of drag on the projectile when fired.

The present invention, in one exemplary embodiment, is comprised of a firearm projectile device comprised of a projectile body with a first pointed end and a second pointed end. Further, at least one gas block is fixedly attached to the second end. The device provides a projectile with a lower drag coefficient than existing projectiles/bullets to improve projectile performance.

The body of the device may be made from any projectile material known in the art and may also be sized and dimensions for use with any caliber or type of firearm/artillery. In one embodiment, the body is a solid body of continuous construction. In another embodiment, the body is comprised of at least one hollow area that preferably runs the length of the body but terminates at the second end. This embodiment allows more air to pass through the body thus reducing drag and resistance when the device is traveling through the air.

The first end and second end of the body are each comprised of a pointed angle that is preferably, but is not limited to, 1.74 degrees. The second is also fixedly attached to at least one gas block which seals exploding gases from the propellant such that the body is propelled out of the casing and barrel of the firearm. The device may also be comprised of a propellant and a primer.

The present invention is also comprised of a method of using the device. First, a device is provided comprised of a body comprised of a hollow area, at least one gas block attached to a second end of the body, at least one primer, at least one propellant, and at least one casing. Then, the second end of the body is attached to the gas block. Next, the second end, gas block, propellant, and primer are placed into the casing. Then, the device 100 can be fired from a firearm and/or artillery.

Accordingly, the firearm projectile device of the present invention is particularly advantageous as it provides an improved projectile that increases the range and effectiveness of a firearm and/or artillery. More specifically, the device increases the range and effectiveness of a firearm and/or artillery. To do so, the hollow configuration of the device decreases the coefficient of drag on the projectile when fired. In this manner, the firearm projectile device overcomes the limitations of existing projectiles known in the art.

Referring initially to the drawings, FIG. 1 illustrates a side cross-sectional view of one potential embodiment of a firearm projectile device 100 of the present invention in accordance with the disclosed architecture. The device 100 is comprised of a projectile body 110 with a first pointed end 120 and a second pointed end 130, wherein at least one gas block 140 is fixedly attached to the second end 130. The device 100 provides a projectile with a lower drag coefficient than existing projectiles/bullets to improve projectile performance.

The body 110 of the device 100 may be made from any projectile material known in the art. Said material includes, but is not limited to, lead, copper, steel, tungsten, depleted uranium, bismuth, tin, polymer, rubber, aluminum, etc., or any combination thereof.

The body 110 may be sized and dimensions for use with any caliber or type of firearm/artillery. This includes bullet/projectile sizes such as, but is not limited to, .22 LR, 9 mm Parabellum, .45 ACP, .380 ACP, .357 Magnum, .308 Winchester, .223 Winchester, 5.56x45 mm NATO, 7.62x39 mm, 7.62x51 mm, 12-gauge slug, .50 BMG, 20 mm, 105 mm Howitzer, 155 mm Howitzer, 88 mm, 40 mm, etc.

In one embodiment, the body 110 is a solid body of continuous construction. In another embodiment, the body 110 is comprised of at least one hollow area 112. The area 112 preferably runs the length 114 of the body 110 but terminates at the second end 130 (or maybe completely hollow in one embodiment). The diameter/size of the area 112 may be different in different embodiments. A hollow embodiment of the body 110 allows more air to pass through the body 110 reducing drag and resistance.

The body 110 is comprised of a first end 120 with a first pointed angle 122. The angle 122 is preferably, but is not limited to, 1.74 degrees. The second end 130 of the body 110 is also comprised of at least one pointed angle 132. The angle 132 is preferably, but is not limited to, 1.74 degrees. The angles 122, 132 further reduce the coefficient of drag of the body 110 during flight.

The second 130 is also fixedly attached to at least one gas block 140. The gas block 140 is preferably the same diameter as the body 110. The gas block 140 seals exploding gases from the propellant 160 such that the body 110 is propelled out of the casing 170 and barrel of the firearm. The device 100 may also be comprised of a primer 150 of any type and strength such as, but not limited to, a boxer primer, a Berdan primer, a rimfire primer, a centerfire primer, an electric primer, a percussion primer, a stab primer, a tube primer, etc. The propellant 160 may be any type of firearm and/or artillery propellant known in the art such as, but not limited to, black powder, smokeless powder, single base powder, double base powder, triple base powder, cordite, ballistite, EC powder, extruded powder, ball powder, flake powder, composite propellants, etc. The second end 130, gas block 140, primer 150, and propellant 160 are stored within a casing 170 of any size and configuration.

Figure 2:
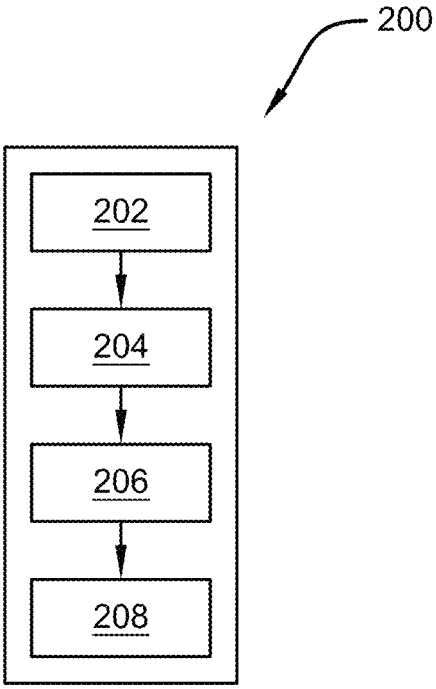
FIG. 2 illustrates a flowchart of a method of using one potential embodiment of a firearm projectile device of the present invention in accordance with the disclosed architecture.

The present invention is also comprised of a method of using 200 the device 100, as seen in FIG. 2. First, a device 100 is provided comprised of a body 110 comprised of a first pointed end 120, a second pointed end 130, and a hollow area 112, at least one gas block 140 attached to a second end 130 of the body 110, at least one primer 150, at least one propellant 160, and at least one casing 170 [Step 202]. Then, the second end 130 of the body 110 is attached to the gas block 140 [Step 204]. Next, the second end 130, gas block 140, propellant 160, and primer 150 are placed into the casing 170 [Step 206]. Then, the device 100 can be fired from a firearm and/or artillery [Step 208].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "firearm projectile device" and "device" are interchangeable and refer to the firearm projectile device 100 of the present invention.

Notwithstanding the foregoing, the firearm projectile device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the firearm projectile device 100 as shown in the FIGS. are for illustrative purposes only, and that many other sizes and shapes of the firearm projectile device 100 are well within the scope of the present disclosure. Although the dimensions of the firearm projectile device 100 are important design parameters for user convenience, the firearm projectile device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A firearm projectile device comprising:

a body comprised of a pointed first end having a first angle and a pointed second end having a second angle;

a gas block;

a primer;

a propellant; and a casing, wherein the first angle is equal to the second angle.

2. The firearm projectile device of claim 1, wherein the first angle is 1.74 degrees.

3. The firearm projectile device of claim 1, wherein the body is comprised of a lead, copper, a steel, a tungsten, a depleted uranium, a bismuth, a tin, a polymer, a rubber, or an aluminum.

4. The firearm projectile device of claim 1, wherein the body is comprised of a .22LR bullet, a 9MM Parabellum bullet, a .45 ACP bullet, a .380 ACP bullet, a .357 Magnum bullet, a .308 Winchester bullet, a .223 Winchester bullet, a 5.56x45 mm NATO bullet, a 7.62x39 mm bullet, a 7.62x51 mm bullet, a 12 gauge slug, a .50 BMG bullet, a 20 mm projectile, a 105 mm Howitzer projectile, a 155 mm Howitzer projectile, an 88 mm projectile, or a 40 mm projectile.

5. The firearm projectile device of claim 1, wherein the body is comprised of a hollow area .

6. The firearm projectile device of claim 5, wherein the hollow area begins at the first end and terminates at the second end.

7. The firearm projectile device of claim 5, wherein the hollow area extends from the first end to the second end.

8. The firearm projectile device of claim 1, wherein the second end fixedly attaches to the gas block.

9. The firearm projectile device of claim 1, wherein the diameter of the gas block is equal to the diameter of the body.

* * * * *